US008038876B2

(12) United States Patent
Yoo et al.

(10) Patent No.: US 8,038,876 B2
(45) Date of Patent: Oct. 18, 2011

(54) FILTER ASSEMBLY OF WASHER

(75) Inventors: Sang Hee Yoo, Gyeongsangnam-do (KR); Jong Deuk Bae, Gyeongsangnam-do (KR); Kil Su Kim, Gyeongsangnam-do (KR); Ji Maeng Kim, Gyeongsangnam-do (KR); Young Bae Park, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 293 days.

(21) Appl. No.: 12/402,237

(22) Filed: Mar. 11, 2009

(65) Prior Publication Data

US 2009/0235960 A1 Sep. 24, 2009

(30) Foreign Application Priority Data

Mar. 12, 2008 (KR) ..... 10-2008-0022973

(51) Int. Cl.
*B01D 35/02* (2006.01)
*D06F 39/10* (2006.01)

(52) U.S. Cl. ..... 210/167.01; 210/171; 210/232; 210/459; 168/12.13; 168/18 F

(58) Field of Classification Search ..... 210/167.01, 210/171, 232, 416.1, 459, 460; 68/12.13, 68/18 F, 18 FA, 235 R
See application file for complete search history.

(56) References Cited

U.S. PATENT DOCUMENTS 5,989,418 A * 11/1999 Shin ..... 210/167.01
2008/0216522 A1* 9/2008 Yoo et al. ..... 68/18 F

FOREIGN PATENT DOCUMENTS

AU 700656 B2 1/1999
GB 2339705 A * 2/2000
JP 59-077893 A 5/1984
JP 1-230394 A 9/1989

* cited by examiner

*Primary Examiner* — Fred Prince

(74) *Attorney, Agent, or Firm* — Birch, Stewart, Kolasch & Birch, LLP

(57) ABSTRACT

A filter assembly of a washer is disclosed, by which laundry can be prevented from being damaged by friction with the filter assembly in a manner of efficiently filtering off particles contained in water in the course of washing the laundry. In a washer including an inner wall having an outlet and a circulation passage provided between the inner wall and a wash tub to enable water to circulate to the outlet from a bottom of the wash tub, the present invention includes a filter unit filtering off particles from the water discharged from the outlet and a cap having an injection hole to enable the water through the filter unit to be injected into the wash tub.

14 Claims, 7 Drawing Sheets

[Fig. 1]
Prior Art
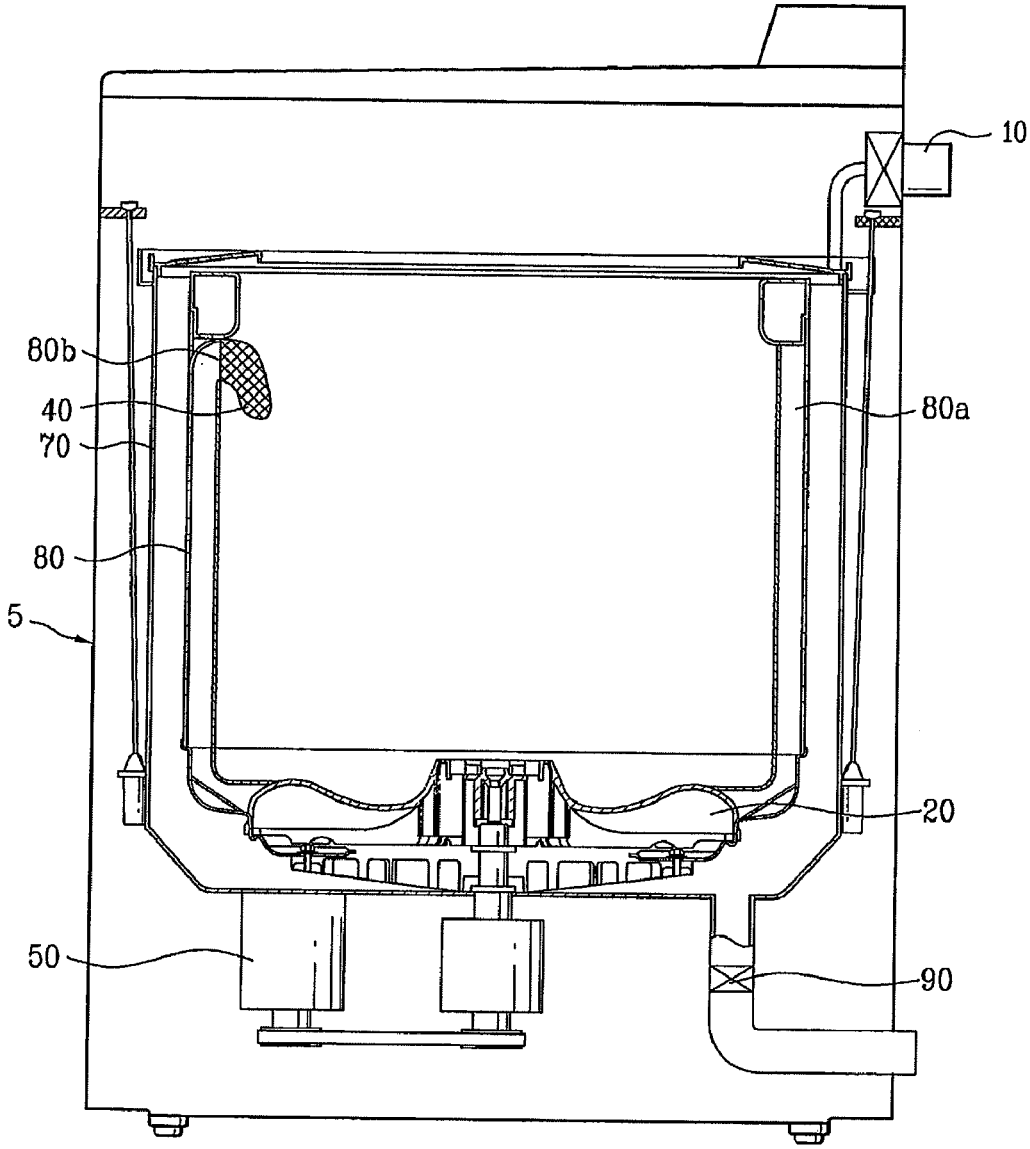

[Fig. 2]
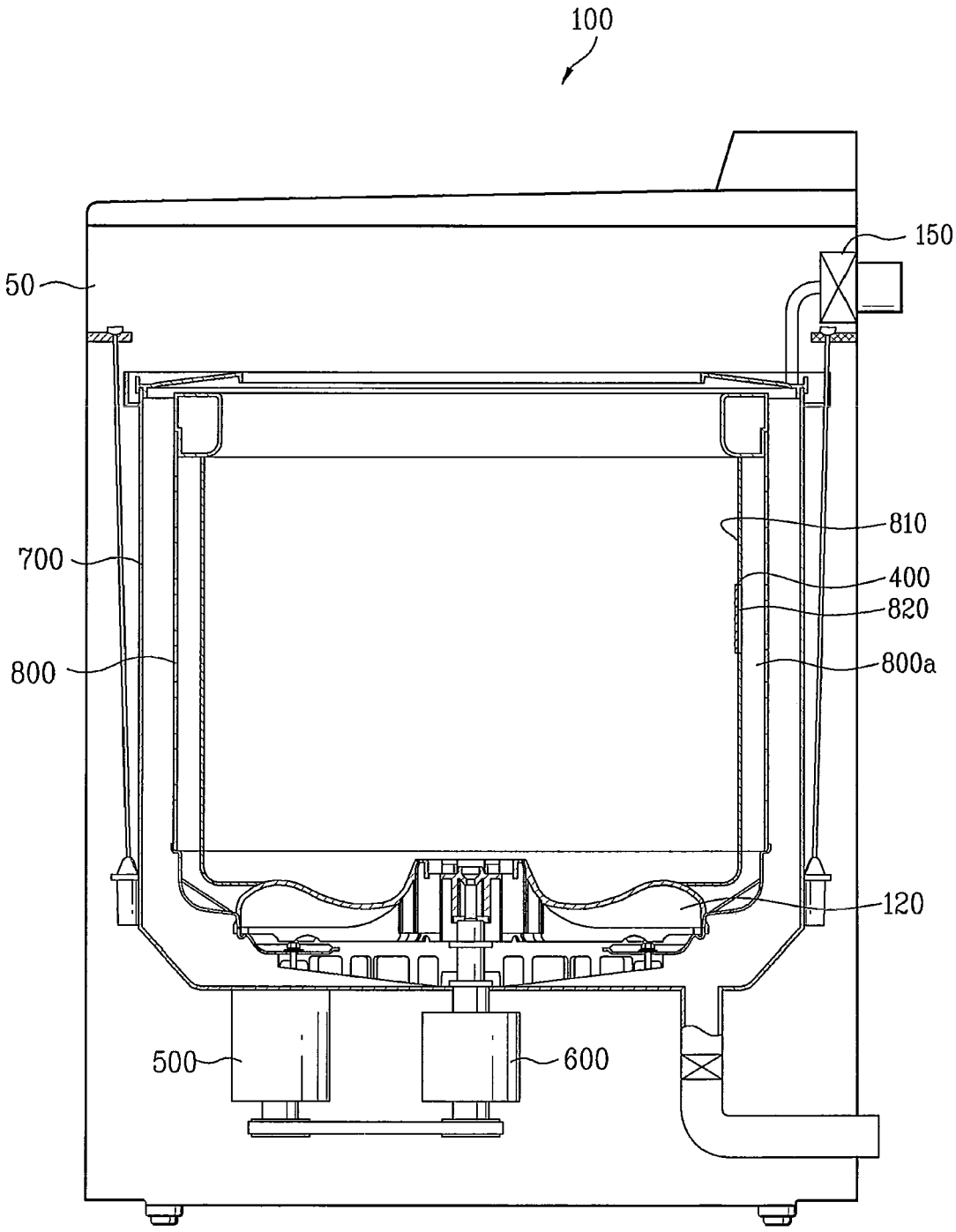

[Fig. 3]
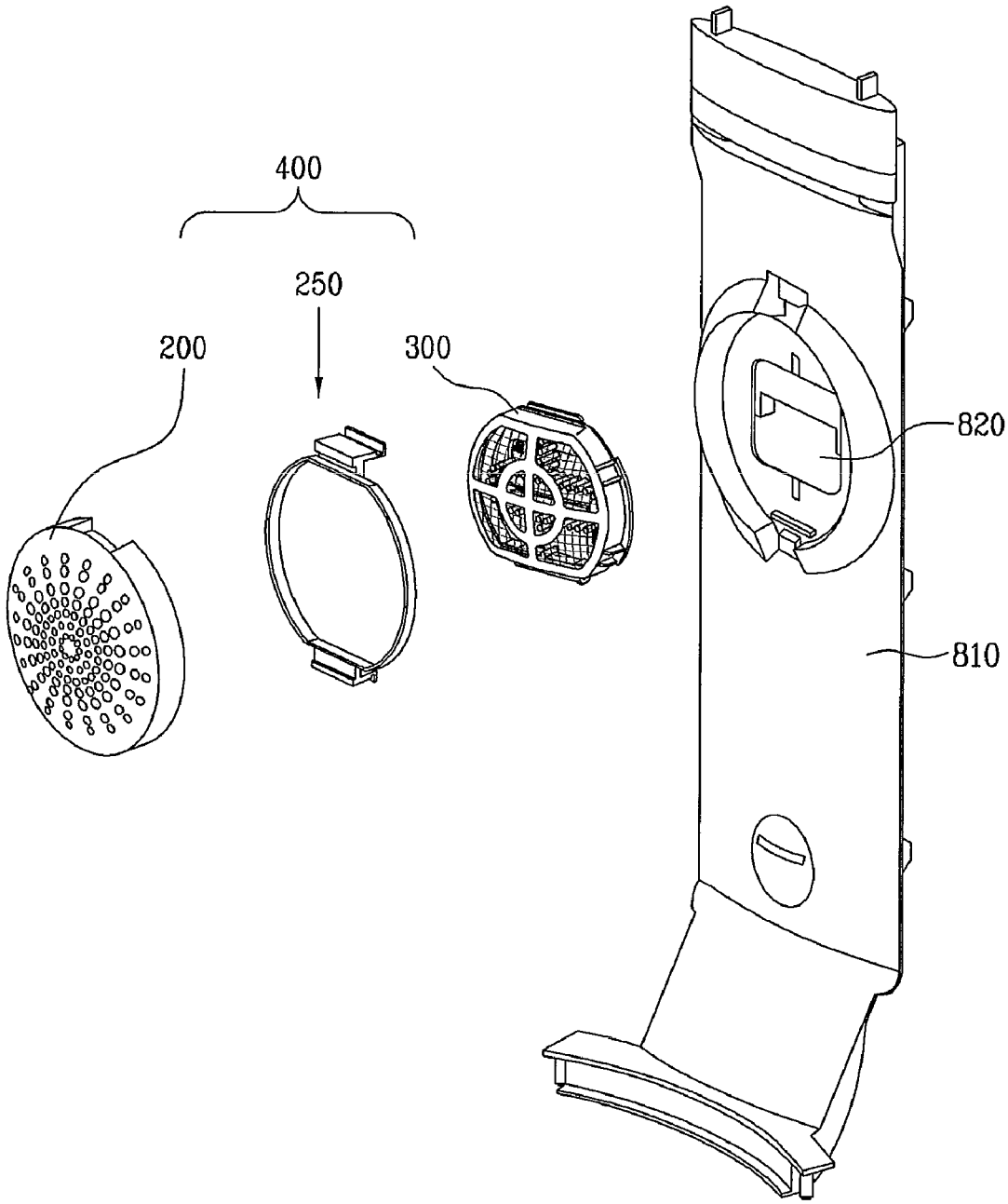

[Fig.4a]
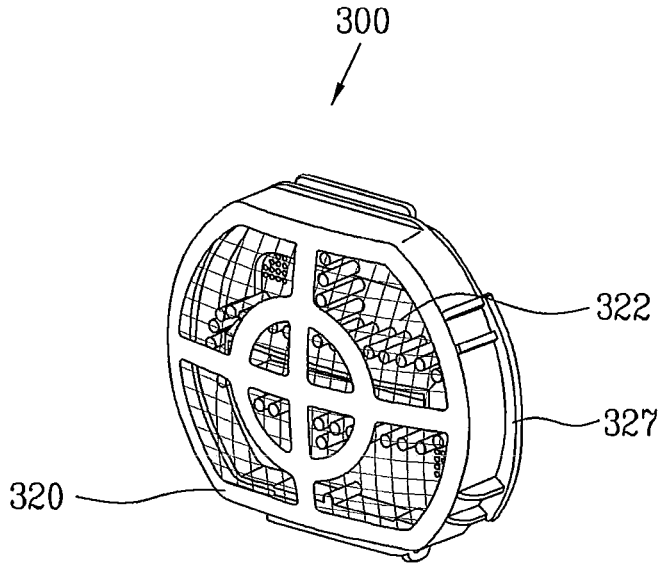
[Fig. 4b]
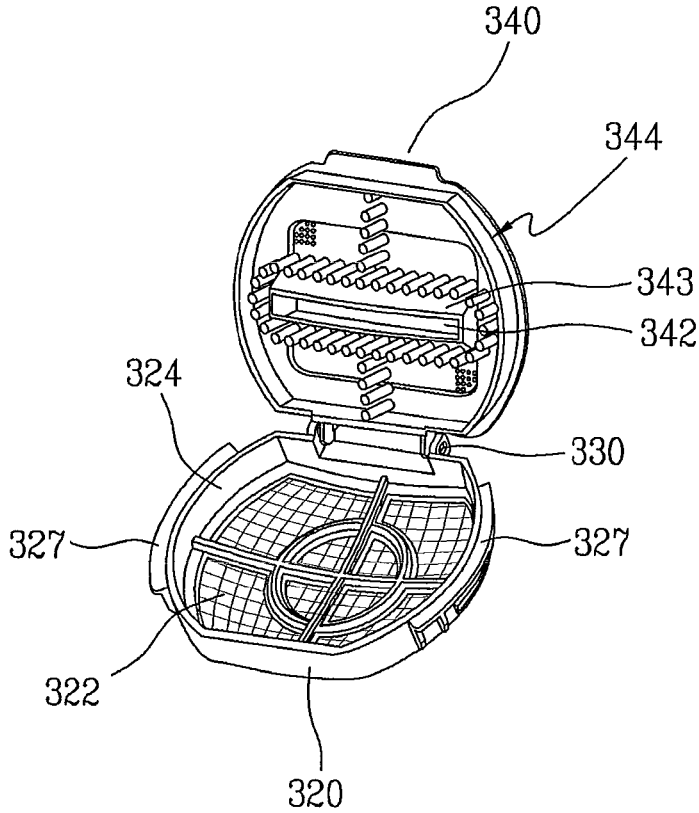

[Fig. 5]
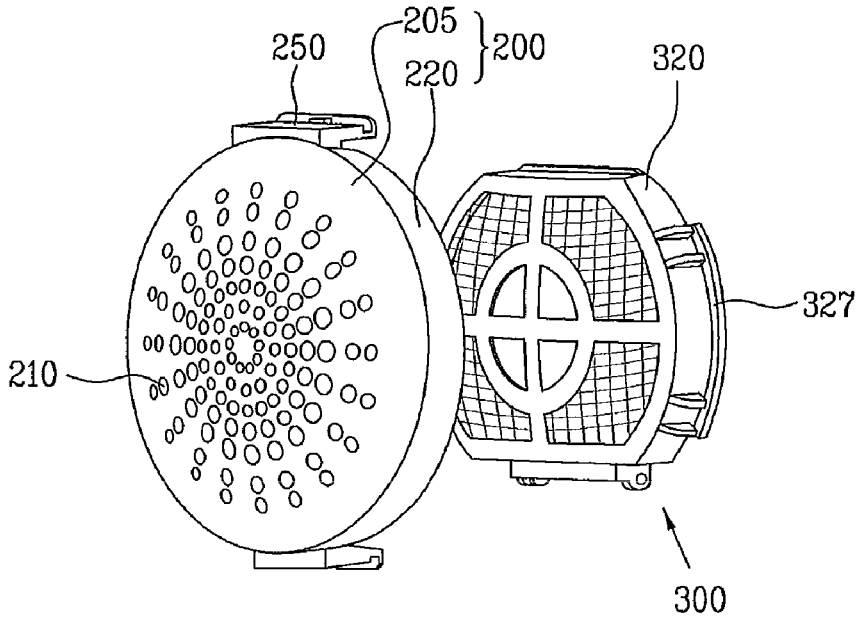
[Fig. 6]
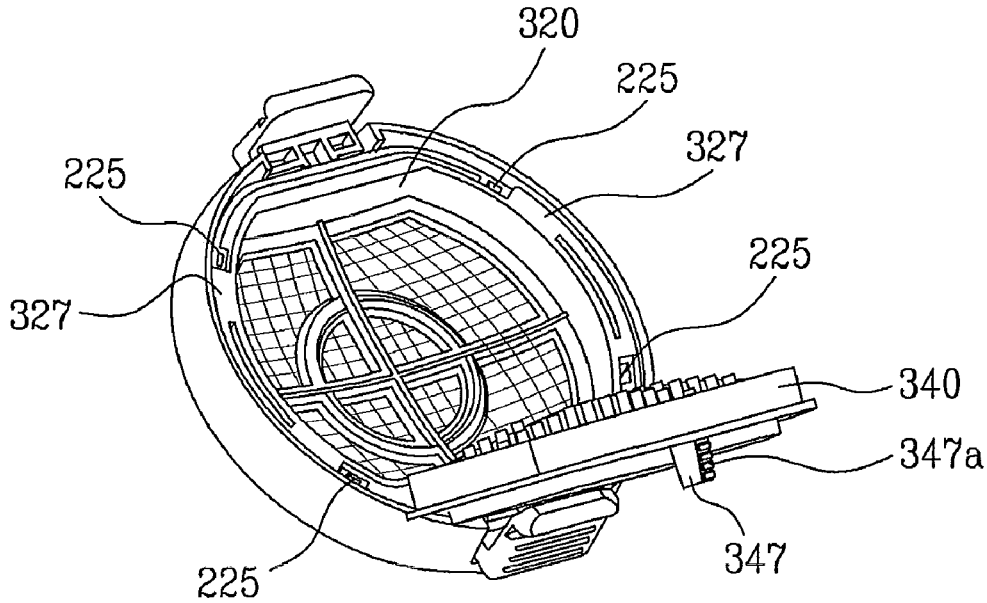

[Fig. 7]
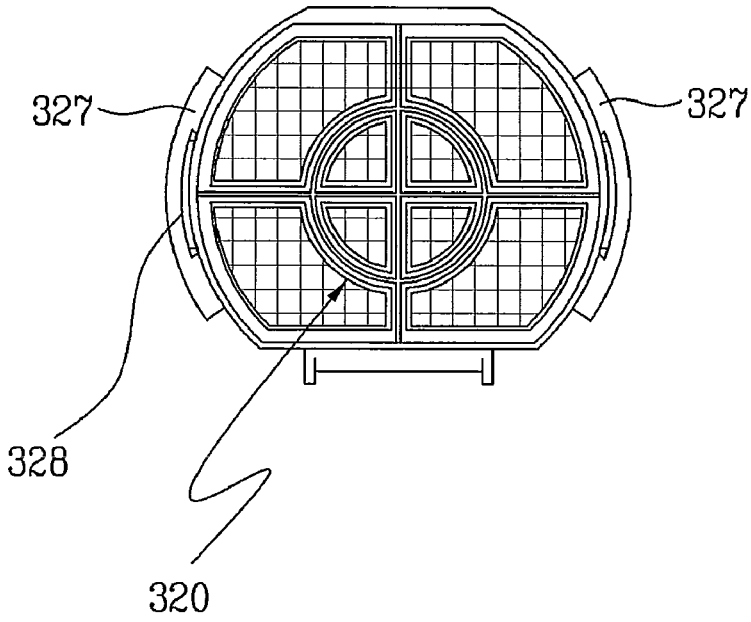
[Fig. 8]
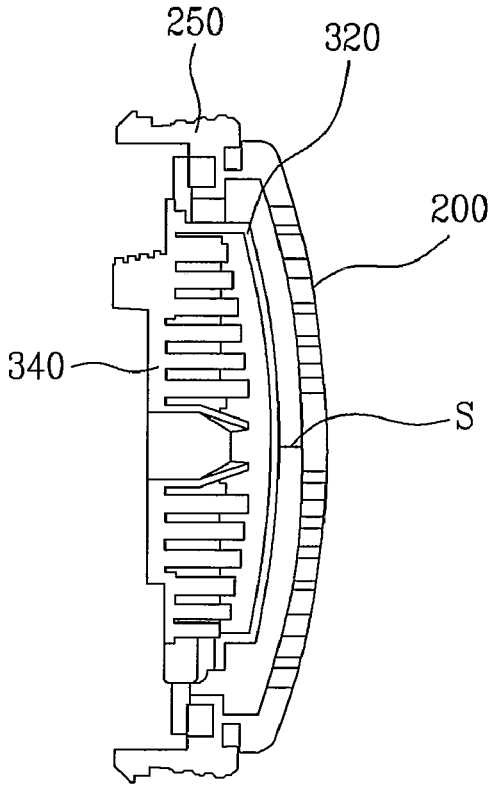

[Fig. 9a]
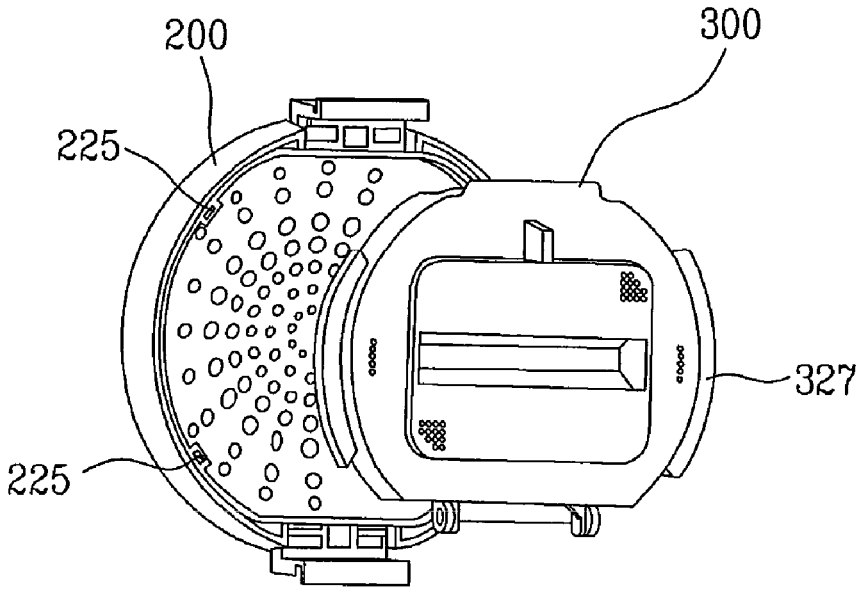
[Fig. 9b]
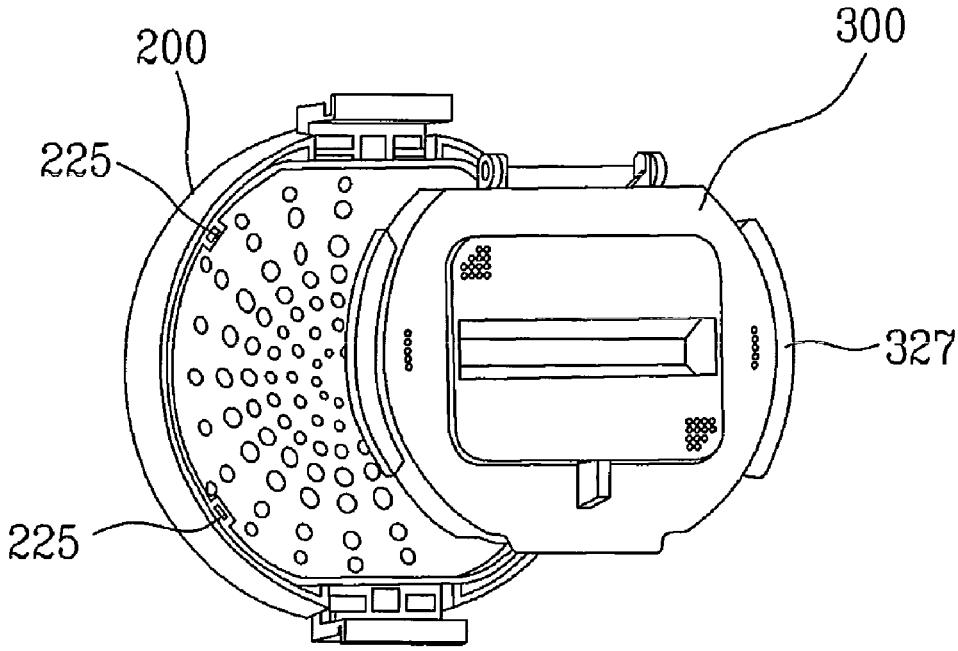

FILTER ASSEMBLY OF WASHER

This application claims the benefit of the Korean Patent Application No. 10-2008-0022973, filed on Mar. 12, 2008, which is hereby incorporated by reference as if fully set forth herein.

BACKGROUND OF THE INVENTION

1. Field of the Invention

The present invention relates to a filter, and more particularly, to a filter assembly of a washer. Although the present invention is suitable for a wide scope of applications, it is particularly suitable for filtering water in a washer that filters and circulates water within a wash tub.

2. Discussion of the Related Art

FIG. 1 is a cross-sectional diagram of a washer according to a related art. In the following description, a related art washer is explained with reference to FIG. 1.

Referring to FIG. 1, a washer according to a related art consists of a main body 5 of the washer, a water storing tub 70 provided within the main body 5 to accommodate water therein, a dewatering tub 80 provided inside the water string tub 70 to perform washing and dewatering on laundry, a pulsator provided under the dewatering tub 80 to wash to laundry by rotating to generate water current, and a drive assembly 50 for rotating the pulsator 20.

And, a water supply assembly is installed over the water storing tub 70. Water supplied from the water supply assembly 10 is supplied to the water storing tub 70 and is then stored therein.

A drain assembly 10 is installed under the water storing tub 70 to discharge the water from the water storing tub 70 after completion of washing.

A passage 80*a* is provided inside the dewatering tub 80 to enable the water stored in the dewatering tub 80 to ascend over the dewatering tub 80 according to the rotation of the pulsator 20.

An injection hole 80*b* is provided to an upper part of the passage 80 to introduce the water having ascended along the passage 80*a* into the dewatering tub 80 again.

A mesh net 40 is further provided to the injection hole 80*b* to filter off particles contained in the water.

In the above-configured washer of the related art, if the pulsator 20 rotates, the water stored within the wash tub ascends along the passage 80*a*, passes through the injection hole 80*b* and the mesh net 40 to filter of particles, and is then supplied within the dewatering tub 80.

However, in the related art washer, the mesh net 40 is projected from an inner wall of the washer in part. Therefore, while laundry is washed, the laundry and the mesh net 40 collide with each other to abrade or tear the mesh net 50. If the mesh net 40 is torn, particles filtered off by the mesh net 40 may be re-introduced into the dewatering tub 80. And, the laundry is caught on the mesh net 40 to be damaged.

Moreover, the mesh net 40 is capable of filter off particles contained in the water only but is unable to inject water on laundry. Therefore, the mesh net 40 has the configuration failing to implement a function of raising wash efficiency.

SUMMARY OF THE INVENTION

Accordingly, the present invention is directed to a filter assembly of a washer that substantially obviates one or more problems due to limitations and disadvantages of the related art.

An object of the present invention is to provide a filter assembly, by which the filter assembly for filtering water is not projected from a wash tub.

Another object of the present invention is to provide a filter assembly, by which wash performance can be enhanced in a manner of filtering water and injecting the filtered water on laundry.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a filter assembly of a washer, which includes an inner wall having an outlet and a circulation passage to enable water to circulate to the outlet from a wash tub, according to the present invention includes a filter unit filtering off particles from the water discharged from the outlet and a cap having an injection hole to enable the water through the filter unit to be injected into the wash tub.

Preferably, the cap is configured to be detachably attached to the inner wall and configures a plane equal to that formed by the inner wall.

More preferably, the filter unit provided between the inner wall and the cap is configured to maintain a prescribed space from the cap attached to the inner wall.

Preferably, the filter unit includes a front cover having a mesh for filtering off the particles and a rear cover assembled with the front cover to enable the water discharged from the outlet to be introduced therein. In this case, the filter unit includes a closed-type filter unit configured to form a sealed space by assembling the front cover and the rear cover together.

More preferably, the closed-type filter unit is inserted in the inner wall in a direction of the circulation passage.

More preferably, the rear cover includes an inlet for introducing the water discharged from the outlet.

In this case, the filter assembly of the washer further includes a passage rib configured to guide an introduction of the water along a circumference of the inlet.

And, the passage rib is configured to incline to prevent a backward flow of the water.

More preferably, the front cover includes a first rib provided in a direction of the rear cover. The rear cover includes a second rib provided in a direction of the front cover. And, the second rib is inserted in the first rib in case of assembling the front cover and the rear cover together.

More preferably, the cap is detachably attached to the closed-type filter unit by snap-fit.

More preferably, a guide rib is provided to an outer circumference of the front cover and a fixing projection for having the guide rib inserted therein is provided to the cap.

In this case, the closed-type filter unit is configured to be horizontally and vertically symmetric and the closed-type filter unit is assembled with the cap irrespective of its vertical direction.

Moreover, the front cover includes first and second guide ribs symmetrically provided to the outer circumference and the cap includes one pair of fixing projections having the first guide rib inserted therein and the other pair of the fixing projections having the second guide rib inserted therein.

Besides, the guide rib further includes a protruding portion configured to enable the cap to be assembled to the closed-type filter unit by maintaining a prescribed space in-between.

More preferably, the closed-type filter unit further includes a grip configured to facilitate disassembly of the front cover and the rear cover.

In this case, the grip is configured to have prominence and depression.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a cross-sectional diagram of a washer having a mesh net according to a related art;

FIG. 2 is a cross-sectional diagram of a washer having a washer filter assembly according to the present invention;

FIG. 3 is an exploded perspective diagram of a washer filter assembly according to the present invention, in which a separated configuration of the washer filter assembly prior to being assembled to a washer is shown;

FIG. 4A is a perspective diagram of a closed-type filter unit of a washer filter assembly according to the present invention, in which a closed state of the filter unit is shown;

FIG. 4B is a perspective diagram of a closed-type filter unit of a washer filter assembly according to the present invention, in which an open state of the filter unit is shown;

FIG. 5 is an exploded perspective diagram of a cap and closed-type filter unit of a washer filter assembly according to the present invention, in which a front-view state of the washer filter assembly prior to assembling the cap and the closed-type filter unit together is shown;

FIG. 6 is a perspective diagram of a cap and closed-type filter unit of a washer filter assembly according to the present invention, in which a state of the washer filter assembly after assembling the cap and the closed-type filter unit together is shown;

FIG. 7 is a front diagram of a closed-type filter unit of a washer filter assembly according to the present invention;

FIG. 8 is a cross-sectional diagram of a washer filter assembly according to the present invention;

FIG. 9A is an exploded perspective diagram of a cap and closed-type filter unit of a washer filter assembly according to the present invention, in which a rear-view state of the washer filter assembly prior to assembling the cap and the closed-type filter unit together is shown; and FIG. 9B is a perspective diagram of the closed-type filter unit, in which the closed-type filter unit shown in FIG. 9A is rotated.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

The present invention is applicable to a washer. In this case, the washer can have one of various types including a vertical shaft type for rotating a pulsator or a wash tub and the like. In this disclosure, a vertical-shaft type washer having a rotated pulsator is taken as an example for the description of the present invention.

FIG. 2 is a cross-sectional diagram of a washer having a washer filter assembly according to the present invention.

Referring to FIG. 2, a configuration of a washer 100 according to the present invention is explained as follows.

First of all, a washer of the present invention includes a main body 50 configuring an exterior, a wash tub 800 provided within the main body 50 to wash laundry by rotating centering on a vertical axis, and a water storing tub 700 provided outside the wash tub 800 to accommodate water therein.

A pulsator 120 is provided to an inner bottom of the wash tub 800. And, the wash tub 800 and the pulsator 120 are rotated by drive and shaft assemblies 500 and 600 provided under the water storing tub 700.

If the wash tub 800 is rotated by the drive and shaft assemblies 500 and 600, the water stored on the bottom of the wash tub 800 is able to move to an upper part of the wash tub by the corresponding rotational force via a circulation passage 800*a*.

In this case, the circulation passage 800*a* can include a space constructed with an inner wall configured to extend from the pulsator 120 and the wash tub 800.

And, an outlet 820 is provided to the inner wall 810 to enable the water having ascended via the circulation passage 800*a* to be introduced into the wash tub 800.

Meanwhile, a water supply assembly (150) for supplying water to the water storing tub 700 can be provided over the water storing tub 700 by being connected to an external water supply source of the washer.

In the following description, a filter assembly provided to the above-configured washer of the present invention is explained.

FIG. 3 is an exploded perspective diagram of a washer filter assembly according to the present invention, in which a separated configuration of the washer filter assembly prior to being assembled to a washer is shown.

Referring to FIG. 3, a washer 100 of the present invention includes a filter assembly 400 enabling water, which ascends the circulation passage 800*a* and introduced into the outlet 820, to be filtered and injected.

The filter assembly 400 can be detachably provided to the outlet 820 provided to the inner wall 810. Preferably, the filter assembly 400 is inserted in the inner wall 810 to configure the same plane of a plane configured by the inner wall 810.

This is to prevent laundry from being damaged by friction generated between the laundry and the filter assembly 400 when the laundry is washed through the rotation of the wash tub.

For this, the inner wall 810 is preferably configured to have a recess for enabling the filter assembly 400 to be accommodated therein. And, the filter assembly 400 is preferably assembled to the bent inner wall 810.

The filter assembly 400 includes a cap 200 for injecting water into the wash tub 800 and a closed-type filter unit 300 detachably assembled with the cap 200 to filter the water introduced from the outlet 820.

And, the filter assembly 400 according to the present invention can further include a detaching device 250 enabling the cap 200 and the closed type filter unit 300 to be assembled to the outlet 820 provided to the inner wall 810 of the washer.

The detaching device 250 can be built in one body of the cap 200. Alternatively, the detaching device 250 can be provided separate from the cap 200 to enable both of the cap 200 and the closed-type filter unit 300 to be detachably assembled to the inner wall 810.

FIG. 5 is an exploded perspective diagram of a cap and closed-type filter unit of a washer filter assembly according to the present invention, in which a front-view state of the washer filter assembly prior to assembling the cap and the closed-type filter unit together is shown.

A configuration and shape of the cap 200 are explained in detail with reference to FIG. 5 as follows.

Referring to FIG. 5, the cap 200 is preferably configured to enable the closed-type filter unit 300 to be accommodated in its backside.

Therefore, the cap 200 is able to include a cap body 205 having a circular shape and a cap rib 220 configured to extend backward along an outer circumference of the cap body 205.

A multitude of injection holes 210 can be included in the cap body 205. This configuration is provided to enable the water, which was filtered via the closed-type filter unit 300, to be injected into the wash tub 800.

In particular, the water filtered by the closed-type filter unit 300 to circulate into the wash tub 800 is made to pass through the narrow passage, thereby being injected onto the laundry within the wash tub 800.

Therefore, according to the filer unit of the washer of the present invention, since the water circulating into the wash tub 800 is injected on the laundry, the effect of beating and washing the laundry can be caused to enhance wash performance.

The cap rib 220 provides a space for accommodating the closed-type filter unit 300 with the configuration that bent on an outer circumference of the cap body 205. And, the cap rib 220 is configured to be assembled with the detaching device 250.

Therefore, it is preferable that the cap rib 220 is provided with a bent portion for receiving the detaching device 250 therein, as shown in FIG. 3.

Preferably, the cap rib 220 is inserted in the inner wall 810 to be placed in the same plane of the plane configured by the inner wall 810.

This is to prevent the laundry from being damaged by the friction with the filer assembly 400 in a manner that the filter assembly 400 is fitted into the inner wall 810 to be locked.

FIG. 6 is a perspective diagram of a cap and closed-type filter unit of a washer filter assembly according to the present invention, in which a state of the washer filter assembly after assembling the cap and the closed-type filter unit together is shown.

A configuration of a backside of the cap 200 of the present invention is explained with reference to FIG. 6 as follows.

Referring to FIG. 6, the cap 200 can include a fixing projection.

The fixing projection 225 is configured to determine a locking position of the closed-type filter unit 300 when the closed-type filter unit 300 is accommodated in the cap 200. And, the fixing projection 225 is also configured to maintain the holding force between the cap 200 and the closed-type filter unit 300.

Meanwhile, a plurality of the fixing projections 225 can be provided to the backside of the cap 200. In FIG. 6, two pairs of the fixing projections 225 are provided for example.

The fixing projections of each pair are preferably provided to symmetric positions. And, a guide rib 327 of the closed-type filter unit 300 can be inserted in a space provided by a pair of the fixing projections 225, which will be explained in detail later.

FIG. 4A is a perspective diagram of a closed-type filter unit of a washer filter assembly according to the present invention, in which a closed state of the filter unit is shown. And, FIG. 4B is a perspective diagram of a closed-type filter unit of a washer filter assembly according to the present invention, in which an open state of the filter unit is shown.

In the following description, a configuration of the closed-type filter unit 400 of the present invention is explained.

First of all, the closed-type filter unit 300 includes a front cover 320 for separating particles contained in water and a rear cover 340 assembled to the front cover 320.

The front cover 320 and the rear cover 340 can be provided in an open/close configuration for facilitating assembly. This can be implemented by engaging a hinge member 330 between the front cover 320 and the rear cover 340.

Preferably, a front side of the front cover 320 includes a mesh 322 to filter off particles contained in water when the water passes through the front cover 320.

Moreover, a first rib 324 can be configured to backward extend along a circumference of the front cover 320.

And, a guide rib 327 can be further included in an outer circumference of the first rib 324.

Preferably, the guide rib 327 is configured to extend outward from the first rib 324 in a radial direction of the closed-type filter unit 300. More preferably, at least two guide ribs 327 (first and second guide rib) are provided.

The guide rib 327 is configured to facilitate the assembly of the closed-type filter unit 300 and the cap 200 in a manner of being fitted in the fixing projection 225 provided to the backside of the cap 200.

In particular, the guide rib 327 is configured to be fitted in the space provided by a pair of the fixing projections 225.

Therefore, a length or shape of the guide rib 327 is configured enough to correspond to a dimension of the space provided by the fixing projections 225.

FIG. 7 is a front diagram of a closed-type filter unit of a washer filter assembly according to the present invention, and FIG. 8 is a cross-sectional diagram of a washer filter assembly according to the present invention.

Referring to FIG. 7, the guide rib 327 can include a protruding portion 328.

This is to enable a backside of the cap 200, which is assembled to an upper part of the front cover 320 when the cap 200 and the closed-type filter unit 300 are assembled together, to maintain a prescribed space (S) from the mesh 322.

In particular, if the cap 200 and the closed-type filter unit 300 are assembled together, an outer circumference of the first rib 324 of the front cover 320 is inserted inside the cap rib 220 of the cap 200.

In this case, one end portion of the cap rib 220 comes into contact with the guide rib 327 and places on the protruding portion 328 of the guide rib 327.

Alternatively, instead of providing the protruding portion 328, it is able to configure the prescribed space (S) to be maintained in a manner of setting a length of the cap rib 220 to be greater than that of the first rib 324.

If the prescribed space is not maintained between the backside of the cap and the front cover, the water having passed through the mesh partially collides with the backside portion of the cap which is not provided with the injection hole 210. Therefore, a pressure between the cap and the front cover is raised to possibly separate the cap and the closed-type filter unit from each other.

If the prescribed space (S) is maintained between the backside of the cap and the front cover, the water passing through the mesh can be smoothly injected into the wash tub via the injection hole 210.

In the following description, the rear cover 340 is explained in detail with reference to FIG. 4A and FIG. 4B.

First of all, the rear cover 340 is configured to guide water introduced via the outlet 820 and can include an inlet 342, a second rib 344 and a passage rib 343.

The inlet 342 can be provided to a central part of the rear cover 340 to correspond to the outlet 820 provided to the inner wall 810.

The second rib 344 is configured to extend forward along a circumference of the rear cover 340 and is also configured to be fitted in the first rib 324.

Once the front cover and the rear cover 340 are assembled together, the second rib 344 is assembled with the first rib 324 by coming into contact with the first rib 324. Therefore, a sealed space is provided to prevent the water introduced from the outlet from entering outer parts except the mesh 322.

In particular, once the front cover 320 and the rear cover 340 are assembled together, the first rib 324 provided to the front cover 320 covers the second rib 344 provided to the rear cover 340 so that circumferential parts of the front and rear covers 320 and 340 can be completely sealed. Therefore, particles accommodated within the closed-type filter unit 300 according to the mesh 322 are prevented from being discharged outside the closed-type filter unit 300.

The passage rib 343 is provided to a circumference of the inlet 342 provided to the rear cover 340.

And, the passage rib 343 can be configured to extend forward a front side of the rear cover 340 with a prescribed inclination.

Moreover, the passage rib 343 is configured to guide the water introduced into the closed-type filter unit 400 from the outlet 820 via the inlet 342.

In particular, the passage rib 343 extends toward the front side of the rear cover 340 to enable the introduced water to be directly introduced into the mesh 322 of the front cover 320.

And, the passage rib 343 is configured to have the prescribed inclination in order to prevent the water introduced into the closed-type filter unit 300 from flowing backward toward the inlet 342.

Meanwhile, a grip 347 (FIG. 6) can be further provided to a backside of the rear cover 340.

The grip 347 is configured to facilitate the front and rear covers 320 and 340 to be assembled/disassembled.

In particular, a user is facilitated to open/close the closed-type filter unit 300 using the grip 347 in assembling/disassembling the front and rear covers 320 and 340.

As expected for the locked position of the closed-type filter unit 300, the grip 347 is normally wet. Therefore, the grip 347 can further include a multitude of prominences and depressions.

A position of the grip shown in FIG. 6 is just exemplary and the grip can be provided to various positions for implementing the above-described function.

And, the above-configured cap 200 and the closed-type filter unit 300 can be assembled to the cap 200 irrespective of top and bottom directions of the closed-type filter unit.

FIG. 9A is an exploded perspective diagram of a cap and closed-type filter unit of a washer filter assembly according to the present invention, in which a rear-view state of the washer filter assembly prior to assembling the cap and the closed-type filter unit together is shown. And, FIG. 9B is a perspective diagram of the closed-type filter unit, in which the closed-type filter unit shown in FIG. 9A is turned to be inserted in a backside of the cap.

A method of assembling/disassembling the cap 200 and the closed-type filter unit 300 detachably is explained as follows.

First of all, the cap 200 includes the cap body 205 having a plurality of injection holes and the cap rib 220 configured to extend backward along an outer circumference of the cap body 205. And, the cap rib 220 can be correspondingly fitted into the first rib 324 provided to the front cover 320 of the closed-type filter unit 300.

An, a plurality of the fixing projections 225 can be provided to an inside of the cap rib 220 in a manner of being projected.

The guide rib 327 can be provided to the first rib 324 of the front cover 320 to be inserted in the space provided by a pair of the fixing projections 225.

In particular, two pairs of the fixing projections 225 are preferably provided to the backside of the cap 200. More preferably, two guide ribs 327 are provided to the front cover to correspond to the space provided by the two pairs of the fixing projections 225, respectively.

Therefore, when the cap 200 and the closed-type filter unit 300 are assembled together, the corresponding guide rib 327 is fitted into the space provided by the corresponding pair of the fixing projections 225, whereby the cap 200 and the closed-type filter unit 300 can be detachably assembled together.

Moreover, the front cover 320 is preferably configured symmetric vertically and horizontally.

In particular, the guide ribs 327 are preferably provided to the front cover in a manner of being configured symmetric in position and shape. More preferably, the guide ribs 327 are provided to enable an exterior of the front cover to have horizontal and vertical symmetry.

Meanwhile, the fixing projections 225 of the cap for providing the space for accommodating the corresponding guide rib 327 therein can be provided to the backside of the cap 200 by considering the position of the guide rib 327.

As mentioned in the foregoing description, if the fixing projections 225 and the guide ribs 327 are provided, the closed-type filter unit can be assembled to the backside of the cap irrespective of top and bottom, it is able to enhance efficiency of the filter assembly of the washer according to the present invention.

In particular, as the cap 200 and the closed-type filter unit 300 have the horizontally and vertically symmetric configurations, they can be assembled irrespective of their assembly direction.

In the following description, a process for filtering water in the above-configured water filter assembly 400 is explained.

First of all, in performing a washing or rinsing cycle, the pulsator 120 is rotated by the drive assembly 500.

Once the pulsator 120 is rotated, a strong water current is radially generated from water by a corresponding rotational force of the pulsator 120 so that the water can flow upward along the circulation passage 800*a* from a lower part of the wash tub 800.

Subsequently, the water is introduced into the wash tub 800 via the outlet 820 provided to the circulation passage 800 and the filer assembly 400 provided to the outlet 820.

In doing so, the water having passed through the outlet 820 is introduced into the closed-type filter unit 300 via the inlet 342 provided to the rear cover 340 of the closed-type filter unit 300.

And, particles contained in the water introduced into the closed-type filter unit 300 are filtered off by the mesh 322 provided to the front cover 320.

In this case, since the circumferences of the front and rear covers 320 and 340 configuring the closed-type filter unit 300 are sealed by the first rib 324 provided to the front cover 320 and the second rib 344 provided to the rear cover 340, the particles filtered off by the mesh 322 are not discharged from the closed-type filter unit 300.

Moreover, the inclining passage rib 343 is provided around the inlet 342 to guide the water introduced into the closed-type filter unit 300 and to prevent the water from flowing backward in a direction of the inlet 342.

Meanwhile, the water having passed through the closed-type filter unit 300 is injected into the wash tub via the injection hole 210 provided to the cap 200.

In this case, a multitude of injection holes 210 are provided to the cap so that the water through the closed-type filter unit can be introduced into the wash tub 800 via narrow holes. Thus, it is able to provide the water with a strong injection pressure.

Therefore, the water through the injection holes is sprayed onto the laundry stored in the wash tub, whereby washing or rinsing efficiency can be raised.

Moreover, the filter assembly 400 of the washer according to the present invention is provided not to be projected from the inner wall 810, thereby preventing laundry from being damaged by the contact in-between in the course of a washing process.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A filter assembly of a washer, which includes an inner wall having an outlet and a circulation passage provided between the inner wall and a wash tub to enable water to circulate to the outlet from a bottom of the wash tub, the filter assembly comprising:

a filter unit filtering off particles from the water discharged from the outlet; and a cap having an injection hole to enable the water through the filter unit to be injected into the wash tub, wherein the filter unit comprises:

a front cover having a mesh for filtering off the particles;

a rear cover assembled with the front cover to enable the water discharged from the outlet to be introduced therein;

an inlet in the rear cover for introducing the water discharged from the outlet; and a passage rib at a periphery of the inlet configured to guide introduction of the water.

2. The filter assembly of the washer of claim 1, wherein the cap is configured to be detachably attached to the inner wall and configures a plane equal to that formed by the inner wall.

3. The filter assembly of the washer of claim 2, wherein the filter unit provided between the inner wall and the cap is configured to maintain a prescribed space from the cap attached to the inner wall.

4. The filter assembly of the washer of claim 1, wherein the filter unit comprises a closed-type filter unit configured to form a sealed space by assembling the front cover and the rear cover together.

5. The filter assembly of the washer of claim 4, wherein the closed-type filter unit is inserted in the inner wall.

6. The filter assembly of the washer of claim 4, wherein the front cover includes a first rib provided in a direction of the rear cover, wherein the rear cover includes a second rib provided in a direction of the front cover, and wherein the second rib is inserted in the first rib in case of assembling the front cover and the rear cover together.

7. The filter assembly of the washer of claim 4, wherein the cap is detachably attached to the closed-type filter unit by snap-fit.

8. The filter assembly of the washer of claim 4, wherein a guide rib is provided to an outer circumference of the front cover and wherein a fixing projection for having the guide rib inserted therein is provided to the cap.

9. The filter assembly of the washer of claim 8, wherein the closed-type filter unit is configured horizontally and vertically symmetric and wherein the closed-type filter unit is assembled with the cap irrespective of its vertical direction.

10. The filter assembly of the washer of claim 9, wherein the front cover includes first and second guide ribs symmetrically provided to the outer circumference and wherein the cap includes one pair of fixing projections having the first guide rib inserted therein and the other pair of the fixing projections having the second guide rib inserted therein.

11. The filter assembly of the washer of claim 8, wherein the guide rib further includes a protruding portion configured to enable the cap to be assembled to the closed-type filter unit by maintaining a prescribed space in-between.

12. The filter assembly of the washer of claim 4, wherein the closed-type filter unit further includes a grip configured to facilitate disassembly of the front cover and the rear cover.

13. The filter assembly of the washer of claim 12, wherein the grip is configured to have prominence and depression.

14. The filter assembly of the washer of claim 1, wherein the passage rib is configured to incline to prevent a backward flow of the water.

* * * * *